US009539481B2

(12) United States Patent
Solhaug

(10) Patent No.: US 9,539,481 B2
(45) Date of Patent: Jan. 10, 2017

(54) SELECTABLE WEIGHT ASSEMBLY FOR GOLF CLUBS

(71) Applicant: Gisle Solhaug, Risoyveien (NO)

(72) Inventor: Gisle Solhaug, Risoyveien (NO)

( * ) Notice: Subject to any disclaimer, the term of this patent is extended or adjusted under 35 U.S.C. 154(b) by 0 days.

(21) Appl. No.: 14/737,202

(22) Filed: Jun. 11, 2015

(65) Prior Publication Data

US 2015/0360101 A1 Dec. 17, 2015

Related U.S. Application Data

(60) Provisional application No. 62/010,954, filed on Jun. 11, 2014.

(51) Int. Cl.
*A63B 53/16* (2006.01)
*A63B 53/10* (2015.01)

(52) U.S. Cl.
CPC ..... *A63B 60/24* (2015.10); *A63B 53/10* (2013.01); *A63B 60/54* (2015.10); *A63B 2209/00* (2013.01)

(58) Field of Classification Search
CPC ..... A63B 60/24; A63B 53/10; A63B 2209/00; A63B 60/54
See application file for complete search history.

(56) References Cited

U.S. PATENT DOCUMENTS 1,580,724 A 4/1926 Harmon
2,782,035 A 2/1957 East
2,960,133 A 11/1960 Shepherd et al.
4,460,423 A * 7/1984 Bosnia ..... A63B 49/10 156/185
7,407,724 B2 * 8/2008 Coffey ..... H01M 2/0202 29/623.1

(Continued)

*Primary Examiner* — Stephen Blau
(74) *Attorney, Agent, or Firm* — John Lindsay

(57) ABSTRACT

The present invention is directed to a selectable weight assemblies for insertion into a golf club shaft. An embodiment of the selectable weight assembly includes a plug, a sleeve, a socket, a primary weight, and a bushing coaxially assembled in order along a major axis corresponding to the central axis of the golf shaft interior. The plug includes a flange and threaded shaft, the flange including a circumferential lip portion operative to contact the upper surface of the shaft and provide a positive lock for securely keeping the selectable weight assembly secured to the golf club. The threaded shaft extends downwardly and distally from the flange section. The sleeve section is adjacent the plug and substantially cylindrical, with an opening extending therethrough. The sleeve further includes at least one slot extending longitudinally generally in the same direction as the primary axis, facilitating radial expansion of the sleeve. The socket is adjacent to the sleeve and further distal to the plug, the socket having an opening extending therethrough, the width of its upper end sized to slidably fit within the opening of said bottom end of the sleeve. The primary weight is adjacent the socket and further distal to the sleeve, with the width of its upper end sized to slidably fit within the opening of said socket. The bushing is adjacent the primary weight and further distal to the socket, composed of compliant, flexible material and dimensioned for slidable receipt of the slug, providing dampening and positive locking of the selectable weight assembly.

10 Claims, 5 Drawing Sheets

(56) References Cited

U.S. PATENT DOCUMENTS

| | | | | |
|---|---|---|---|---|
| 7,481,716 | B1 * | 1/2009 | Johnson | A63B 60/24 473/297 |
| 8,177,658 | B1 * | 5/2012 | Johnson | A63B 60/24 473/297 |
| 2008/0274823 | A1 * | 11/2008 | Lindner | A63B 53/00 473/297 |
| 2008/0281398 | A1 * | 11/2008 | Koss | A61F 2/95 623/1.12 |

* cited by examiner

SELECTABLE WEIGHT ASSEMBLY FOR GOLF CLUBS

PRIORITY

The present invention claims priority to provisional application 62/010,954, which has a filing date of Jun. 11, 2014.

BACKGROUND

Field of the Invention

The present invention relates to the field of sports equipment, and more particularly to a selectable weight assembly for golf clubs.

Description of the Related Art

The weight of the golf club has been reduced with the advent of modern lightweight shaft materials and technology such as graphite and other materials. The trend to lighter weight shafts and interchangeable club heads is making it more beneficial and desirable to counterbalance the club head by the addition of a selected amount of mass strategically located in the handle region. It has been generally confirmed that, especially with such a lightweight shaft, better control, distance, and accuracy can be obtained by counterbalancing the weight of the club head by the addition of weight at the grip end of the shaft, where an amount of weight can be selected to arrive at an optimal weight and feel for the individual player.

SUMMARY

The present invention is directed to a selectable weight assembly for insertion into a golf club shaft. An embodiment of the selectable weight assembly comprises a plug, a sleeve, a socket, a primary weight, and a bushing coaxially assembled in order along a major axis corresponding to the central axis of the golf shaft interior. The plug comprises a flange and a threaded shaft, the flange comprising a circumferential lip portion operative to contact the upper surface of the shaft and provide a positive lock for securely keeping the selectable weight assembly secured to the golf club. The threaded shaft extends downwardly and distally from the flange section. The sleeve section is adjacent the plug and substantially cylindrical, with an opening extending therethrough. The sleeve further comprises at least one slot extending longitudinally generally in the same direction as the primary axis, facilitating radial expansion of the sleeve. The socket is adjacent to the sleeve and further distal to the plug, the socket having an opening extending therethrough, the width of its upper end sized to slidably fit within the opening of said bottom end of the sleeve. The primary weight is adjacent the socket and further distal to the sleeve, with the width of its upper end sized to slidably fit within the opening of said socket. The bushing is adjacent the primary weight and further distal to the socket, composed of compliant, flexible material and dimensioned for slidable receipt of the slug, providing dampening and positive locking of the selectable weight assembly.

These and other features, aspects, and advantages of the invention will become better understood with reference to the following description, and accompanying drawings.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is believed that any weight added should not be placed in direct metal-to-metal interface contact with the golf club shaft, but instead there should be resilient but firm mounting and include a desirable damping factor. Locating a weighted plug and selectable weights in the top of a golf club grip allows a golfer to modify the total weight, the center of mass, and distributed weight in a golf club, thereby improving the performance and comfort of a golf club to provide greater distance and accuracy.

Figure 1:
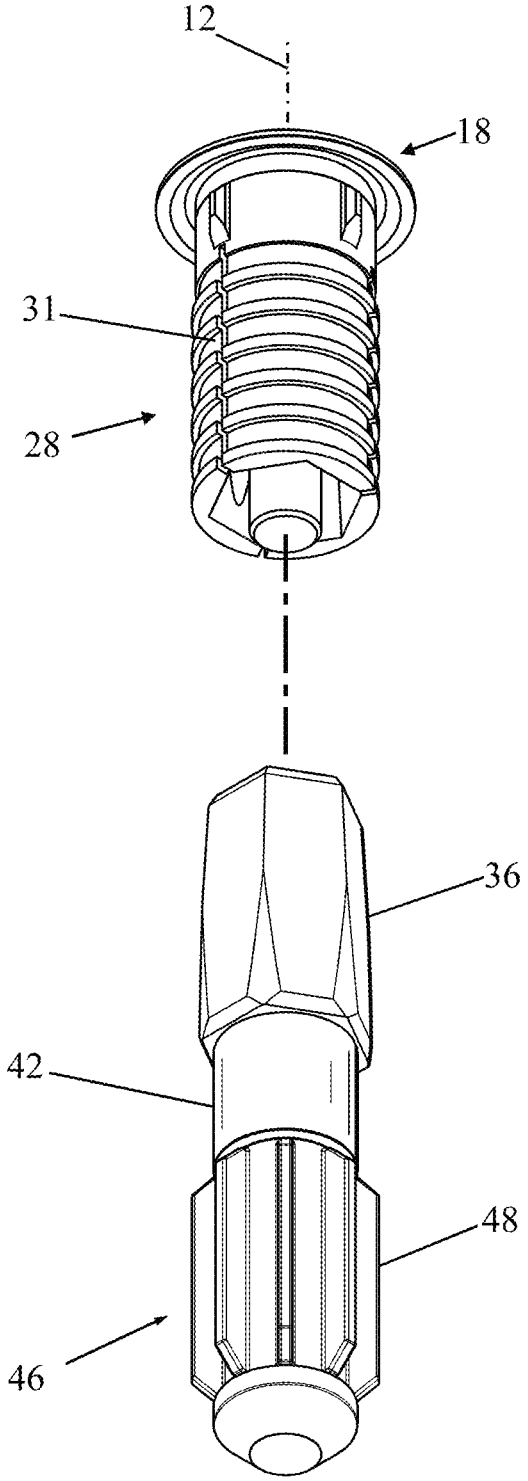
FIG. 1 depicts a side view of an embodiment of a selectable weight assembly for golf clubs according to the current invention.
Figure 2:
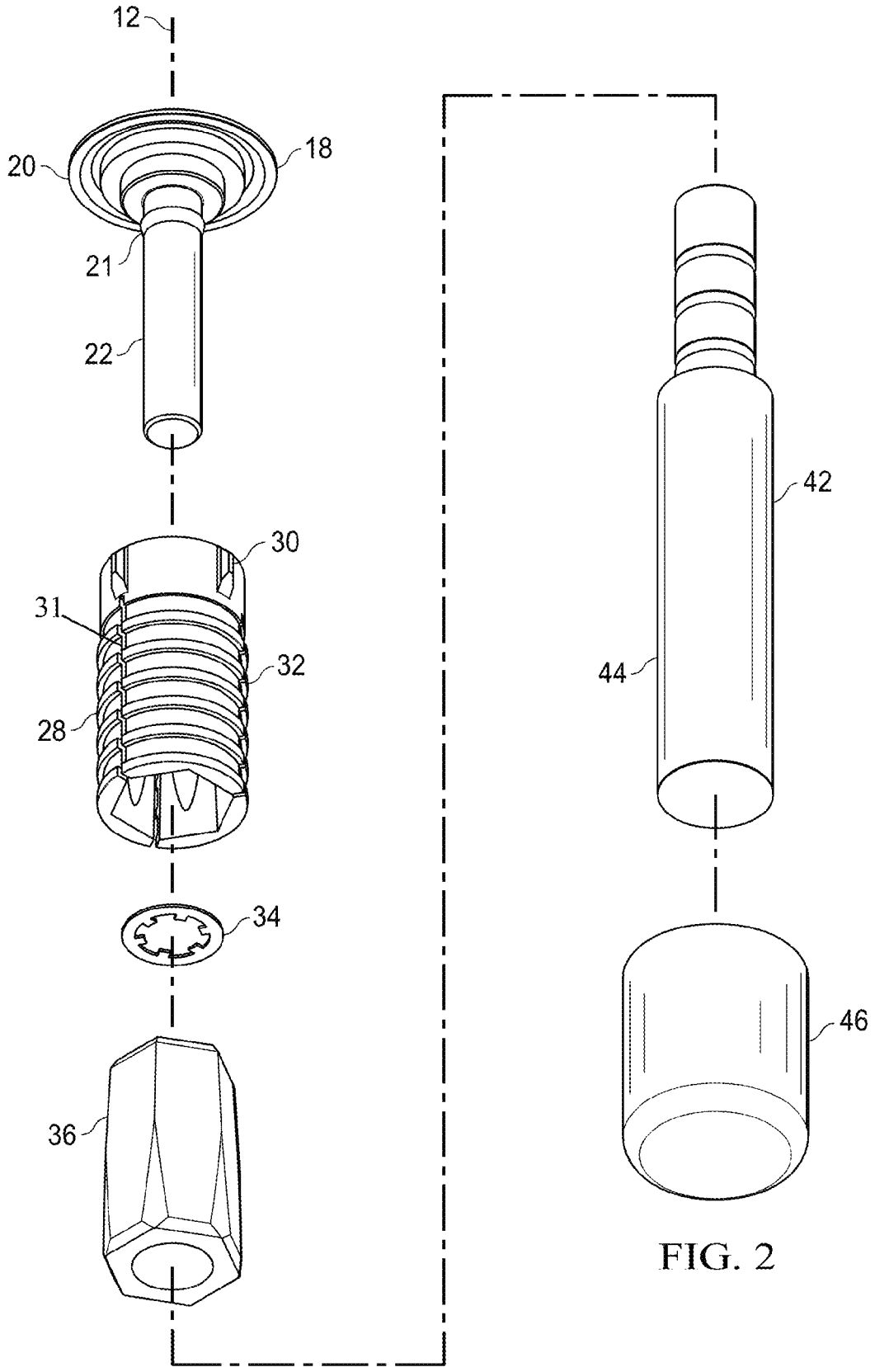
FIG. 2 depicts an exploded view of the embodiment of FIG. 1.
Figure 3:
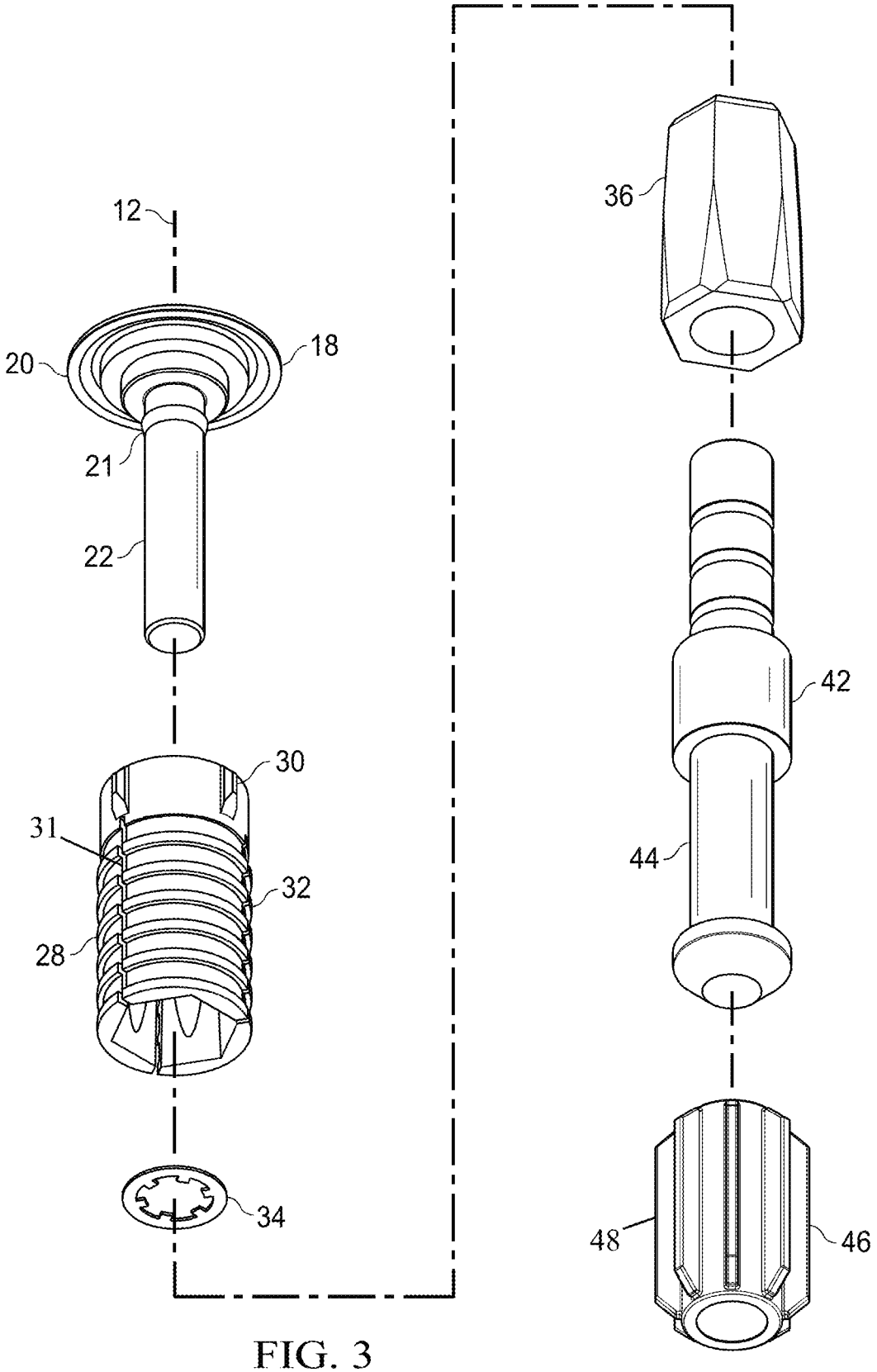
FIG. 3 depicts an exploded view of an alternate configuration of the embodiment of FIG. 1.
Figure 4:
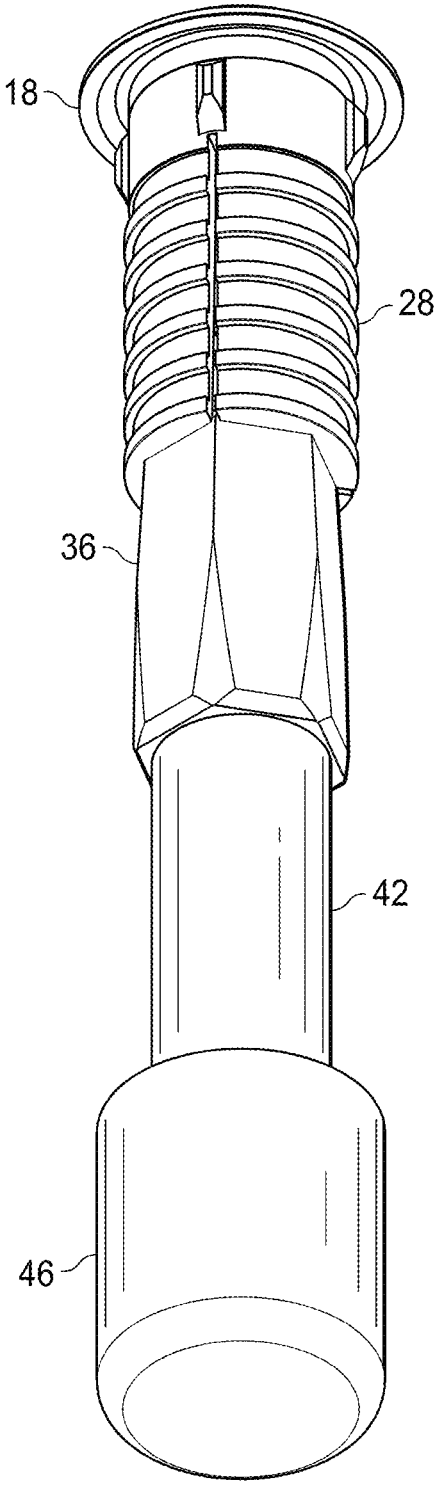
FIG. 4 depicts a side view of an alternate configuration of the embodiment of FIG. 1.

The present invention is a selectable weight assembly for golf clubs for insertion in the shaft of a golf club, with a configured weight, that is inserted into the hollow golf club shaft. FIGS. 1, 2, 3 and 4 depict embodiments of a selectable weight assembly 10 for golf clubs. FIG. 1 depicts an assembled selectable weight assembly 10 according to the current embodiment. FIG. 2 depicts an exploded view of the current embodiment. The depicted embodiment includes a plug 18, a sleeve 28, a socket 36, a primary weight 42 and a bushing 46 coaxially assembled in order along a major axis 12, the axis 12 corresponding with the central axis of a golf shaft interior.

The plug 18 includes a flange 20 and threaded shaft 22. The flange 20 is operative to contact the upper surface of the shaft in order to provide a positive lock for securely keeping the selectable weight assembly 10 resiliently secured to the golf club. In exemplary configuration, the flange 20 is rigid and composed of rigid material. The illustrated flange 20 is slightly wider than the opening presented by the shaft, controlling the depth of insertion of the selectable weight assembly 10 into the shaft of the golf club. It has a circumferential lip portion slightly less than the interior width of the opening presented by the shaft. The threaded shaft 22 extends downwardly and distally from the flange 20 section. In exemplary configuration, it includes a conical section 21 near its upper end.

A sleeve 28 section is adjacent the plug 18. The sleeve 28 has an upper end and a lower end. In exemplary configuration, the sleeve 28 is substantially cylindrical with an opening extending through its length. In one configuration, it has a ribs 30 32 further providing positive locking of the selectable weight assembly 10 relative to the shaft of the golf club. In that configuration, vertically oriented ribs 30 are spaced about the outer surface of the upper end and horizontally oriented ribs 32 are spaced about the lower end. The width of the outer surface, including the raised ribs 30 32, is slightly less than that of the interior width of the shaft portion of the golf club into which the selectable weight assembly 10 will be inserted. In exemplary configuration, the sleeve 28 further includes at least one slot 31 extending longitudinally generally in the same direction as the primary axis 12 facilitating radial expansion of the sleeve 28. The depicted sleeve 28 includes three equally spaced slots 31.

In one configuration, a ring 34 is adjacent the sleeve 28, securing the sleeve 28 in place relative to the plug 18. The depicted ring 34 is composed of spring steel having a perimeter with a slice in order to expand over the conical section and presents an opening. In another configuration, a threaded nut is provided for tightening against the conical section of the bolt 22. In this configuration, the threads of the nut and the threads immediately below the conical section may be made of slightly larger diameter than the main section of the bolt 22. The treads of this larger diameter may be counter-threaded in order to facilitate the nut secure position on removal of the selectable weight assembly 10 from the shaft.

A socket 36 is adjacent the ring 34 and the sleeve 28 and further distal to the plug 18. The socket 36 has an upper end and a lower end. In exemplary configuration, the illustrated socket 36 is generally inverse frustocononical with an opening extending through its length. The width of its upper end is sized to slidably fit within the opening of the bottom end of the sleeve 28. The width of the depicted socket 36 flares out gradually to about the same width as the bottom of the sleeve 28 or a lower portion of the golf club shaft.

A primary weight 42 is adjacent the socket 36, providing a selectable core weight, and further distal to the sleeve 28. The primary weight 42 has an upper end and a lower end. The width of the upper end of the primary weight 42 is sized to slidably fit within the opening of the socket 36. Further, an interior section of the upper end of the primary weight 42 is inversely threaded along the primary axis 12 for receipt of the threaded shaft 22 of the plug 18. The lower end of the primary weight 42 is the slug 44 section, the primary source of weighting. In exemplary configuration, the maximum width of the lower end of the slug 44 section is slightly less than the golf club shaft at the depth which it will be inserted.

The bushing 46 is adjacent the primary weight 42 and further distal to the socket 36, providing dampening and positive locking of the selectable weight assembly 10 in place within the shaft of the golf club. The bushing 46 is composed of compliant, flexible material and dimensioned for slidable receipt of the slug 44. In an alternate configuration, the bushing 46 includes one or more fins 48. The fins 48 are composed of compliant, flexible material and deform to the interior of the golf club shaft.

The total weight can be controlled by the material, volume, and shape of the plug 18, sleeve 28, socket 36, or primary weight 42. Representative materials for weight control include plastics (for example, high density or low density), metals (for example, aluminum, iron, steel, lead, or tungsten), or other materials known in the art. It should be understood that different versions of different values of mass can be created for ready interchange as required for game play. Representative external shapes include cylinders, octagons, quadrangles, triangles, star, or oval shapes.

The current embodiment is operationally assembled coaxially (ie stacked) along the primary axis 12. The threaded shaft 22 of the plug is placed through the openings of the sleeve 28, the ring 34, and the socket 36. The threaded shaft 22 is screwed into the interior threading of the upper portion of the primary weight 42. The bushing 46 is slid over the slug 44 portion of the primary weight 42. In use, the desired weight is chosen and the selectable weight assembly 10 is inserted in the golf club shaft until the flange 20 and bushing 46 secure its position.

Figure 5:
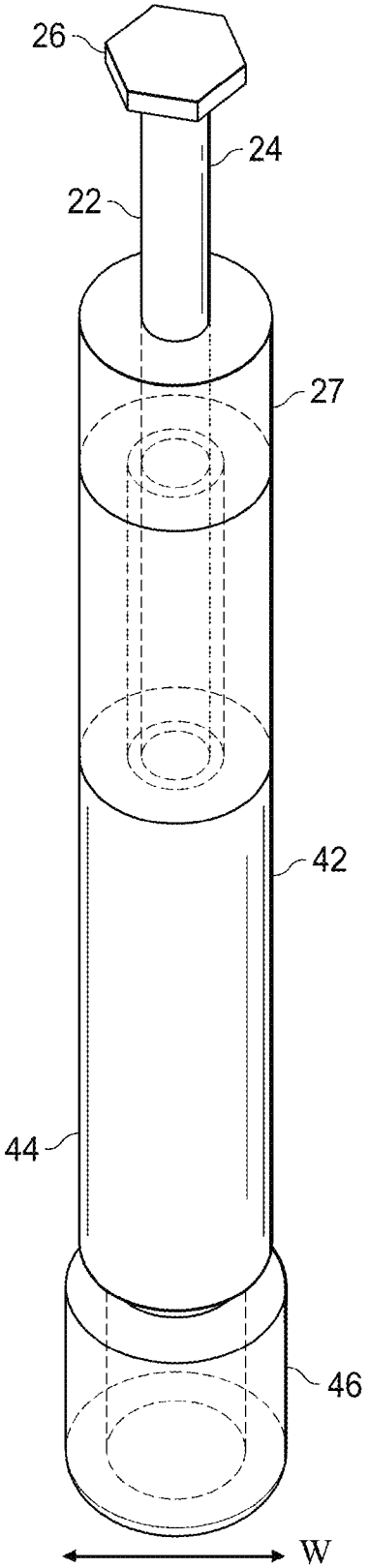
FIG. 5 depicts a side view of an alternate embodiment of a selectable weight assembly for golf clubs according to the current invention.
Figure 6:
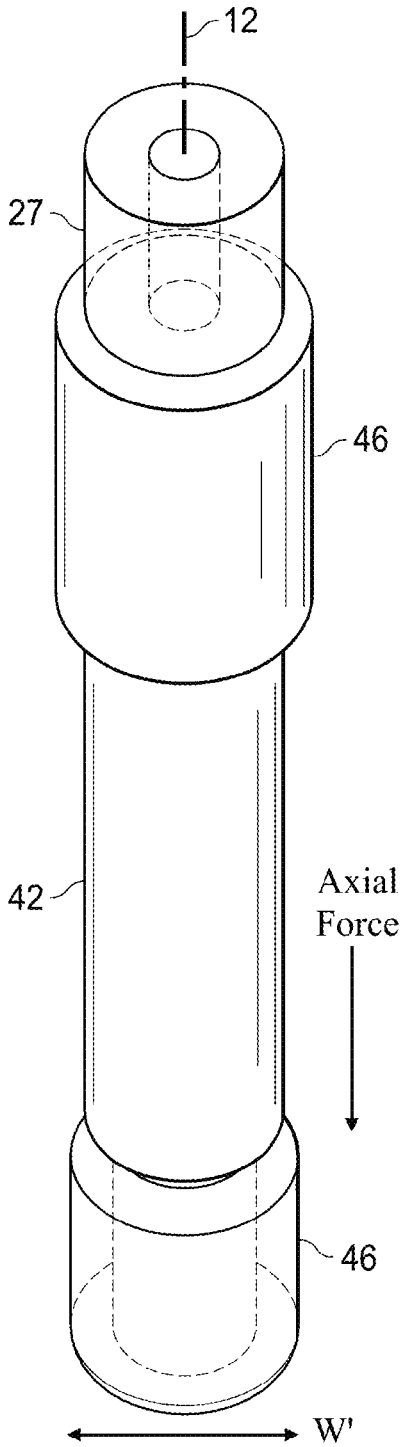
FIG. 6 depicts a side view of an alternate configuration of the embodiment of FIG. 5.

FIGS. 5 and 6 depict an alternate embodiment of a selectable weight assembly 10 of the current invention. The embodiment includes a retaining screw 24, a primary weight 42, a bushing 46, and a sleeve 27 operationally coaxially assembled in order along an axis 12, the axis 12 corresponding with the central axis of a golf shaft interior.

The retaining screw 24 includes a screw head 26 and a threaded shaft 22. A primary weight 42 is adjacent the retaining screw 24, providing a core weighted section. The primary weight 42 has an upper end and a lower end. The primary weight 42 includes an inversely threaded interior extending completely through it along the primary axis 12 for receipt of the threaded shaft 22 of the retaining screw 24. The lower end of the primary weight 42 is the slug 44 section, the primary source of weighting. In exemplary configuration, the slug 44 section is cylindrical and slightly less than the interior of the sleeve 27 into which it will be slidably inserted.

The bushing 46 is adjacent the primary weight 42 providing dampening at the lower end of the selectable weight assembly 10. The bushing 46 is composed of elastic, compliant material, such as rubber or another elastomer. In the depicted embodiment, the rubber is vulcanized to the lower end of the slug 44, encompassing the end including the hole at the end of the threaded interior extending through the length of the primary weight 42. In its untensioned state, the affixed rubber of the bushing 46 is of a first width W slightly greater than the width of the shaft at the desired depth in the shaft.

A sleeve 27 section encompasses major portions of both the retaining screw 24 and the primary weight 42, leaving the bushing 46 exposed. In exemplary configuration, the sleeve 27 is substantially cylindrical with an opening extending through its length. Its width is slightly less than the interior width of the shaft of the golf club.

Again, the total weight of the embodiment can be selectively altered by the material, volume and shape of the retaining screw 24, primary weight 42, and sleeve 27. Representative materials for weight control include plastics (high density, low density) or metals (aluminum, iron, steel, lead or tungsten). It should be understood that different versions of different values of mass can be created for ready interchange as required for game play. Representative external shapes include cylinders, octagons, quadrangles, triangles, star, or oval shapes.

The current embodiment is operationally assembled coaxially along the primary axis 12. The bushing 46 is secured over the slug 44 portion of the primary weight 42. The sleeve 27 is slid over the major retaining screw 24 and primary weight 42 sections, leaving the bushing 46 exposed. In use, the threaded shaft 22 is screwed into the interior threading of the upper portion of the primary weight 42 through the lower slug 44 portion of the primary weight 42 until it abuts the interior side of the bushing 46. The threaded shaft 22 is further rotated, stretching the bushing 46 and deforming it such that its width decreases to W' under the applied axial force of the threaded shaft 22. The embodiment is then slid into the shaft of the golf club to the desired depth. The threaded shaft 22 is counter-rotated, removing the applied axial force, whereby the bushing 46 returns to its relaxed state and expands radially, providing an expansive force for secure frictional contact with the interior surface of the shaft.

Insofar as the description above and the accompanying drawing disclose any additional subject matter that is not within the scope of the single claim below, the inventions are not dedicated to the public and the right to file one or more applications to claim such additional inventions is reserved.

What is claimed is:

1. A selectable weight assembly for insertion into a golf club shaft comprising:

a retaining screw, a primary weight, and a bushing, and coaxially assembled along a major axis corresponding to the central axis of said golf shaft interior;

said retaining screw comprising a screw head and a shaft;

said primary weight adjacent said retaining screw, said primary weight having an upper end and a lower end, said primary weight including a hollow interior extending therethrough for receipt of said shaft of said retaining screw, the lower end of said primary weight having a slug section, said bushing adjacent said primary weight and composed of elastic, compliant material, and affixed to and encompassing the end of said primary weight, said bushing of a first untensioned width slightly greater than the width of the shaft at a selected depth;

whereby the threaded shaft is engaged through said interior of said primary weight through, deforming said bushing such that its width decreases under the applied axial force, and upon removal of the applied axial force, returning the bushing to its untensioned state, providing an expansive force for secure frictional contact with the interior surface of the shaft.

2. The selectable weight assembly of claim 1 wherein said bushing includes one or more fins on its outer surface.

3. The selectable weight assembly of claim 2 wherein said fins are vertically oriented.

4. The selectable weight assembly of claim 2 wherein said fins are horizontally oriented.

5. The selectable weight assembly of claim 2 wherein said fins includes vertically oriented fins and at least one horizontally oriented fin on its outer surface.

6. The selectable weight assembly of claim 1 wherein said bushing is composed of an elastomer.

7. The selectable weight assembly of claim 1 wherein said bushing is vulcanized to said slug section.

8. The selectable weight assembly of claim 1 wherein said primary weight is composed of at least one of the following: high density plastics, low density plastics, aluminum, iron, steel, lead and tungsten.

9. The selectable weight assembly of claim 1 wherein said primary weight is generally cylindrical.

10. The selectable weight assembly of claim 1 further comprising a sleeve, said sleeve encompassing major portions of both said retaining screw and said primary weight, leaving the bushing exposed, said sleeve having a width slightly less than the interior width of the shaft of the golf club.

* * * * *